US006487526B1

(12) United States Patent
Mitchell

(10) Patent No.: US 6,487,526 B1
(45) **Date of Patent: *Nov. 26, 2002**

(54) VECTOR CORRELATOR FOR SPEECH VOCODER USING OPTICAL PROCESSOR

(75) Inventor: James P. Mitchell, Cedar Rapids, IA (US)

(73) Assignee: Rockwell Collins, Cedar Rapids, IA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/291,529

(22) Filed: Apr. 14, 1999

(51) Int. Cl.[7] ..... G10L 19/00

(52) U.S. Cl. ..... 704/201; 704/500

(58) Field of Search ..... 704/270, 200, 704/201, 216, 217, 218, 500, 501, 502, 503, 504, 203, 223, 222

(56) References Cited

U.S. PATENT DOCUMENTS

| | | | | | |
|---|---|---|---|---|---|
| 5,150,242 | A | * | 9/1992 | Fellows | 359/108 |
| H1586 | H | * | 9/1996 | Fellows et al. | 252/582 |
| 5,640,383 | A | * | 6/1997 | Kamoto et al. | 369/275.3 |
| 6,216,267 | B1 | * | 4/2001 | Mtchell | 725/93 |

* cited by examiner

*Primary Examiner*—Richemond Dorvil
(74) *Attorney, Agent, or Firm*—Nathan O. Jensen; Kyle Eppele

(57) ABSTRACT

The present invention is a system and method for processing and encoding audio information. An audio transducer receives audio information, preferably continuously, and converts the audio information into a signal representative of the audio information. A digital processing system receives the signal and electronically processes the audio signal. An optical processing system operatively couples with the digital processing system and performs a signal processing algorithm on the signal whereby the signal is encoded. The encoded signal is optimized for transmission over a very low bandwidth transmission channel. The encoded signal may be received and decoded with a system that may include a second optical processing and/or memory system.

19 Claims, 4 Drawing Sheets

VECTOR CORRELATOR FOR SPEECH VOCODER USING OPTICAL PROCESSOR

FIELD OF THE INVENTION

The present invention generally relates to the field of information processing systems, and particularly to a system and method for processing audio information using optical processing techniques.

BACKGROUND OF THE INVENTION

Voice encoders (VOCODERS) are utilized for processing audio information such as a speech signal. Such voice encoder systems are typically semiconductor based using semiconductor based digital electronic circuits for processing the audio information. Traditional semiconductor based digital electronic processors are typically serial devices processing data in a serial manner, i.e. a first operation is performed on a first set of data before a second set of data is fetched and operated upon. Although advents in semiconductor based processor architectures, such as predictive branching and higher processor speed, have provided processors capable of performing increasingly faster operations, the fundamental serial structure of semiconductor processing systems inherent in the device technology (e.g., von Neumann architecture) have limited the speed at which complex processing algorithms such as signal processing and compression may be performed with a general purpose semiconductor based processor. Further, although specialized semiconductor processors have been developed having architectures optimized for signal processing algorithms (e.g., digital signal processors, Harvard architecture), semiconductor devices still exhibit considerable signal processing limits. These problems become apparent when it is desired to process and transmit a voice or similar audio signal over a limited bandwidth transmission channel. VOCODER designs such as those utilized in the telephone industry function at the phonetic level with sounds and utterances such that a codebook or library of sounds by necessity is kept minimal in size (e.g., 512 phonemes). However, only smaller sized codebooks may be utilized since traditional semiconductor processors do not provide the necessary processing power to work with larger, massive sized codebooks. Increasing the size of the codebook would provide higher speech quality and lower bandwidth requirements, but at the expense of requiring significantly faster and more powerful sequential processors that may not exist, or may be too expensive or impractical for a given application. Lack of adequate processing power introduces processing latencies resulting in unacceptable speech quality and audio delay in the system.

Optical processing systems that utilize holographic image processing techniques are capable of processing information in parallel such that much more complex two-dimensional functions such as compression, correlation, and transform decomposition of audio time and frequency elements may be processed in a shorter amount of time than with traditional semiconductor processors. Such optically implemented signal processing functions may provide optimized transmission of speech signals over much lower bandwidth channels with much higher speech quality. For example, many voice encoders today have limits at or near 2.4 kilobits per second (kbps) (e.g. FED-STD-1016: CELP (4.8 kbps); FED-STD-1015: LPC-10e (2.4 kbps), ITUG.7231.1: CELP (5.3 and 6.3 kbps); IMBE (2.4 to 9.6 kbps), MPEG-4: Parametric (2 to 8 kbps), MIL-STD-118-113: CVSD (16 and 32 kbps)). Search for technology to dramatically reduce the required bandwidth for voice transmission is pressured by an entire industry of wired and wireless telecommunications companies seeking ways to offer more voice channels over limited numbers of communication channels or through constrained bandwidth. Thus, there lies a need for an audio processing, encoding, decoding and transmission system that utilizes optical processing to provide faster and more optimized transmission of audio signals such as speech signals over lower bandwidth transmission channels.

SUMMARY OF THE INVENTION

The present invention is directed to a system for processing and encoding audio information. In one embodiment, the system includes an audio transducer for receiving audio information and converting the audio information into a signal representative of the audio information, a digital processing system for receiving the signal and for electronically processing the audio signal, and an optical processing system operatively coupled with the digital processing system for performing a signal processing algorithm on the signal whereby the signal is encoded, the encoded signal being optimized for transmission over a lower bandwidth transmission channel.

The present invention is also directed to a method for processing and encoding audio information for transmission over a lower bandwidth channel. In one embodiment, the method includes steps for receiving the audio information and transducing the audio information into a signal representative of the audio information, electronically processing the signal, and optically processing the signal using an optical processing system such that the signal is encoded for optimal transmission over a lower bandwidth transmission channel. Both the method and the system of the present invention are capable of leveraging the enormous associative and correlating properties of an optical processing system that may occur in real-time with an extremely large, massive amount of data, making the optical processing system ideal for implementing simultaneous data correlation.

It is to be understood that both the foregoing general description and the following detailed description are exemplary and explanatory only and are not restrictive of the invention as claimed.

The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiment of the invention, an example of which is illustrated in the accompanying drawings.

Figure 1:
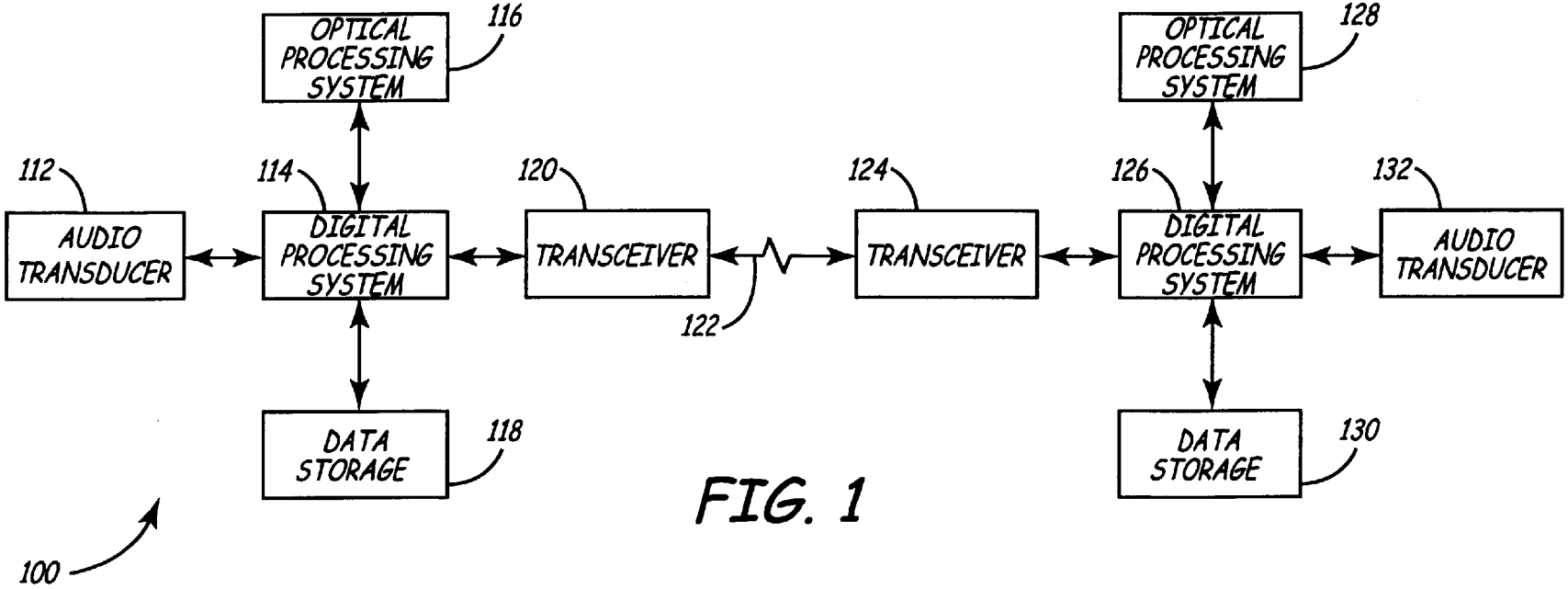
FIG. 1 is a block diagram of an audio processing system capable of optically processing an audio information signal in accordance with the present invention.

Referring now to FIG. 1, a block diagram of an audio processing system capable of optically processing an audio information signal will be discussed. The system 100 captures, preferably continuously, audio information with an audio transducer 112 that may comprise, for example, a microphone and. preamplifier. The information captured by transducer 112 is provided to a digital processing system 114 that may be, for example, an electronic computer system. A Vanderlugt (or similar) optical processing system 116 couples to digital processing system 114 for performing signal processing algorithms utilizing an optical signal processing apparatus.

In operation, audio processing system 100 receives audio information with audio transducer 112, for example information contained in the voice of a user of system 100. The audio information is transduced into a signal representative of the audio information and is provided to digital processing system 114. The signal may be intended to be transmitted to a remote device or location with a transceiver 120 coupled to digital processing system 114. Typically, the bandwidth of the channel 122 over which the audio signal is to be transmitted is too narrow for real-time transmission of the complete, full bandwidth analog signal. The signal therefore may be processed by an optical processing system 116 coupled to digital processing system 114 prior to transmission such that the audio signal is optimized for continuous transmission over the limited bandwidth transmission channel 122. Optical processing system 116 may be preprogrammed with a massive library or codebook of signal transforms and/or holographic image correlator templates for implementing a wide range of image decomposition functions including Fourier transforms, Hartley transforms, discrete valued transforms (e.g., z-transforms), transform inversions, signal compression, filtering, time warping etc. A data storage device 118 may be coupled to digital processing system 114, for example for caching audio signal data during processing as required.

After optical system 116 performs desired signal processing, the digital audio signal may be transmitted via channel 122 to be received by a second transceiver 124 disposed at a remote location. The received audio signal is processed by a second digital processing system 126 coupled to transceiver 124 for reconstructing the audio signal. A second optical processing system 128 coupled to digital processing system 126 may implement algorithms for reconstructing the audio signal (e.g., inverse transforms). The audio signal may then be reproduced with audio transducer 132 (e.g., amplifier and loudspeaker) upon reconstruction of the audio signal. A data storage device 130 coupled to digital processing system 126 may be used for caching the audio signal during processing as required, or for longer term storage of the audio signal. As required by the particular application in which audio system 100 is utilized, the transforms or correlations performed by the Vanderlugt (or similar) optical processing systems 116 and 128 may be optimally selected for the particular channel utilization and audio transducer. For example, a first optical processing algorithm and system may be selected for processing voice signals over a telephone network, a second algorithm or system may be selected for processing voice signals to be transmitted over a narrow band radio-frequency network, a third algorithm or system may be selected for processing voice signals transmitted over a cellular telephone network, a fourth algorithm or system may be selected for processing voice signals over a satellite network, and so on.

Figure 2:
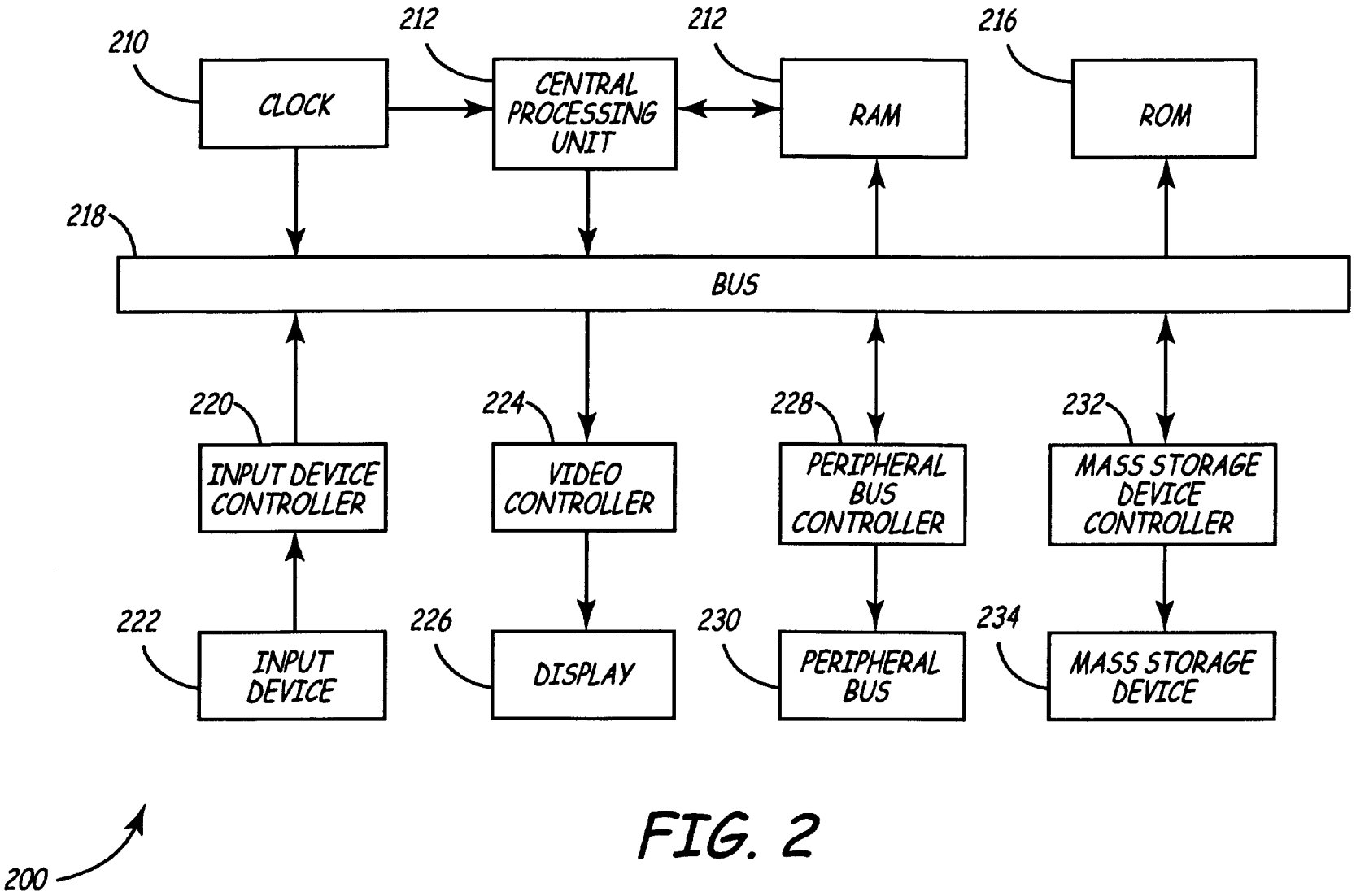
FIG. 2 is a block diagram of a computer hardware system operable to tangibly embody a digital processing system of an audio processing system of the present invention.

Referring now to FIG. 2, a computer hardware system operable to tangibly embody a digital processing system of an audio processing system of the present invention will be discussed. The computer system 200 may be utilized for either digital processing system 114 or digital processing system 126 and generally includes a central bus 218 for transferring data among the components of computer system 200. A clock 210 provides a timing reference signal to the components of computer system 200 via bus 218 and to a central processing unit 212. Central processing unit 212 is utilized for interpreting and executing instructions and for performing calculations for computer system 200. Central processing unit 212 may be a special purpose processor such as a digital signal processor. A random access memory (RAM) device 214 couples to bus 218 and to central processing unit 212 for operating as memory for central processing unit 212 and for other devices coupled to bus 218. A read-only memory device (ROM) 216 is coupled to the components of computer system 200 via bus 218 for operating as memory for storing instructions or data that are normally intended to be read but not to be altered except under specific circumstances (e.g., when the instructions or data are desired to be updated). ROM device 216 typically stores instructions for performing basic input and output functions for computer system 200 and for loading an operating system into RAM device 214.

An input device controller 220 is coupled to bus 218 for allowing an input device 222 to provide input signals into computer system 200. Input device 222 may be a keyboard, mouse, joystick, trackpad or trackball, microphone, modem, or a similar input device. Further, input device 222 may be a graphical or tactile input device such as a touch pad for inputting data with a finger or a stylus such. Such a graphical or tactile input device 222 may be overlaid upon a screen of a display device 226 for correlating the coordinates of a tactile input with information displayed on display 226. Display 226 is controlled by a video controller 224 that provides a video signal received via bus 218 to display 226. Display 226 may be any type of display or monitor suitable for displaying information generated by computer system 200 such as cathode ray tube (CRT), a liquid crystal display (LCD), gas or plasma display, or a field emission display panel. Preferably, display 226 is a flat-panel display having a depth being shallower than its width. A peripheral bus controller 228 couples peripheral devices to central bus 218 of computer system 200 via a peripheral bus 228. Peripheral bus 230 is preferably in compliance with a standard bus architecture such as an Electrical Industries Association Recommended Standard 232 (RS-232) standard, an Institute of Electrical and Electronics Engineers (IEEE) 1394 serial bus standard, a Peripheral Component Interconnect (PCI) standard, or a Universal Serial Bus (USB) standard, etc. Transceivers 120 and 124 may couple to digital processing systems 114 and 126, respectively, via peripheral bus 230, for example. A mass storage device controller 232 controls a mass storage device 234 for storing large quantities of data or information, such as a quantity of information larger than the capacity of RAM device 214. Mass storage device 234 is typically non-volatile memory and may be a disk drive such as a hard disk drive, floppy disk drive, optical disk drive, combination magnetic and optical disk drive, etc. Mass storage device 234 may be, for example, data storage devices 118 or 130.

Figure 3:
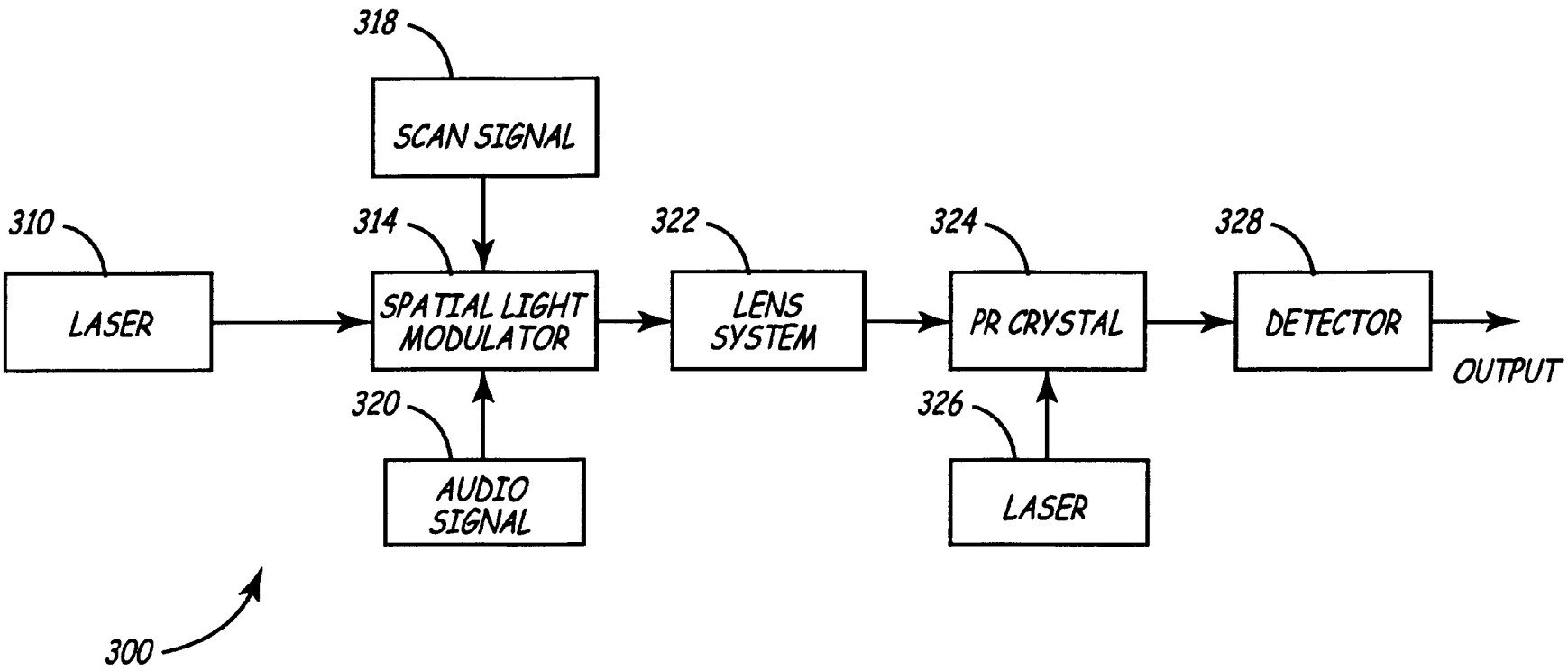
FIG. 3 is a block diagram of a Vanderlugt (or similar) optical processing system for optically processing an audio signal in accordance with the present invention.

Referring now to FIG. 3, an optical processing system (Vanderlugt or similar) for optically processing an audio signal in accordance with the present invention will be discussed. It is noted that Dr. Vanderlugt's optical correlator is a well-known system for performing high-speed template matching correlations, and is extensively referred to in the literature. Furthermore, concepts of optical pattern recognition for matching speech and audio segments for voice identification are known (e.g., *Optical Pattern Recognition*, Neil Collins, page 7, ISBN 0-201-14549-9, 1988). The optical processing system of FIG. 3 may be utilized as one or both of optical processing systems 116 and 128 discussed with respect to FIG. 2. Optical processing system 300 may be utilized to perform a correlation algorithm or the like type of algorithm (e.g., convolution, cross-correlation, autocorrelation, etc.). A reference scan signal 318 and the audio signal 320 to be correlated with scan signal 318 are coupled to a spatial light modulator (SLM) 314 for modulating the light beam output of a laser 310. Signal processing techniques (e.g., compression, signal transforms, etc.) may be implemented by optical processing system 300. In an alternative embodiment, spatial light modulator 314 may include or be substituted with one or more acousto-optic devices (AOD) each receiving a corresponding signal (e.g., scan signal 318 or audio signal 320). In a further alternative embodiment, spatial light modulator may include or be substituted with a liquid-crystal display (LCD), to implement light modulation.

The modulated laser beam is applied to a lens system 322 for directing the beam through a photorefractive (PR) crystal 324, thereby impinging upon a detector 328. The modulated light beam from laser 310 impinges upon photorefractive crystal 324. Furthermore, PR crystal 324 contains data stored holographically that may be utilized in a signal-processing algorithm. PR crystal 324 may be, for example, a Lithium Niobate crystal. A correlation may be performed on audio signal 320 and the data stored in PR crystal 324. Detector 328 may be a charge-coupled device or parallel photodetector array for converting the output to a digital signal readable by digital processing system 114 or 126 for further signal processing. Laser 326 may be optionally utilized for controlling a holographic output of crystal 324.

In one embodiment of the present invention, an encoder-decoder may be developed from a system that receives an address, on the order of 20 bits in length, and forwards the addresses to a mass data storage system containing a complete set of natural digital audio or word recordings. These addresses theoretically enable/vector a playback of up to 1 million ($\sim 2^{20}$) prerecorded natural high quality representations of the original word or words. Because continuous speech can realize word rates at up to 3 to 5 words per second, it is necessary that the complete communications system (end-to-end) exhibit very low processing latency. This requires the mass storage system utilized in retrieving the natural digital audio to be extremely fast as well as having a high capacity. Semiconductor, hard disk, compact disk (CD), digital versatile disk (DVD) or holographic memory systems may be used to supply this capability (e.g., mass storage device 234 or PR crystal 324).

Semiconductor digital processing system 114 preprocesses the audio signal to optimally present frequency or other transformed time domain data of the audio signal to optical processing system 116. Furthermore, digital signal processing system 114 may be used to adapt or time warp incoming audio prior to delivery to optical processing system 116. Optical processing system 116 compares the signal components via an optical transform process implemented by processing system 300 to a library of holographic images stored in photorefractive crystal 324. PR crystal 324 instantaneously develops refracted columniations of light at an output angle unique to each of the holographic image sets (i.e. the codebook). The library or codebook stored in PR crystal 324 may be optimized for a particular application as previously discussed. Upon detection of the refracted beam or beam components on detector 328 (that may be, for example, a one or two-dimensional photosensitive array), a codebook vector is uniquely and instantaneously determined corresponding to a "best match" to the original input signal. The vector may be representative of a unique binary code assignment (e.g., address) that is transmitted over transmission channel 122 via transceiver 120 to a remote receiver or transceiver 124.

Transceiver 124 receives the transmitted address information and immediately delivers the information signal to a mass storage system (that may be, for example, data storage device 130) for playback of a representative audio signal, segment, or word corresponding to the initially received audio information. Semiconductor memory, hard-disk, compact disk (CD), digital versatile disk (DVD) or holographic memory may be utilized as a mass storage system that operates as a read-only memory for fast processing. The resulting audio signal reproduced in this system is as noise free as the recorded digital representation and therefore would provide a higher valued signal-to-noise ratio (e.g., at least 90 dB). No noise would be contained in the resulting output signal due to channel noise that may be present on transmission channel 122. Vocal attribute data of the speaker may be encoded and transmitted with the word vectors for redeveloping the speech characteristics of the original speaker (e.g., pitch, inflection). Furthermore, the information may be transmitted over a lower bandwidth (e.g., lower bit rate) transmission channel 122. It will be seen that the received input signal may also include other types of information signals in addition to or instead of a speech signal. For example, the received, processed, and transmitted signal may be representative of, but not limited to, speech, audio, video, data, multimedia (e.g., audio, video and data representative of a program of instructions or an applet executable by a digital processing system).

Figure 4:
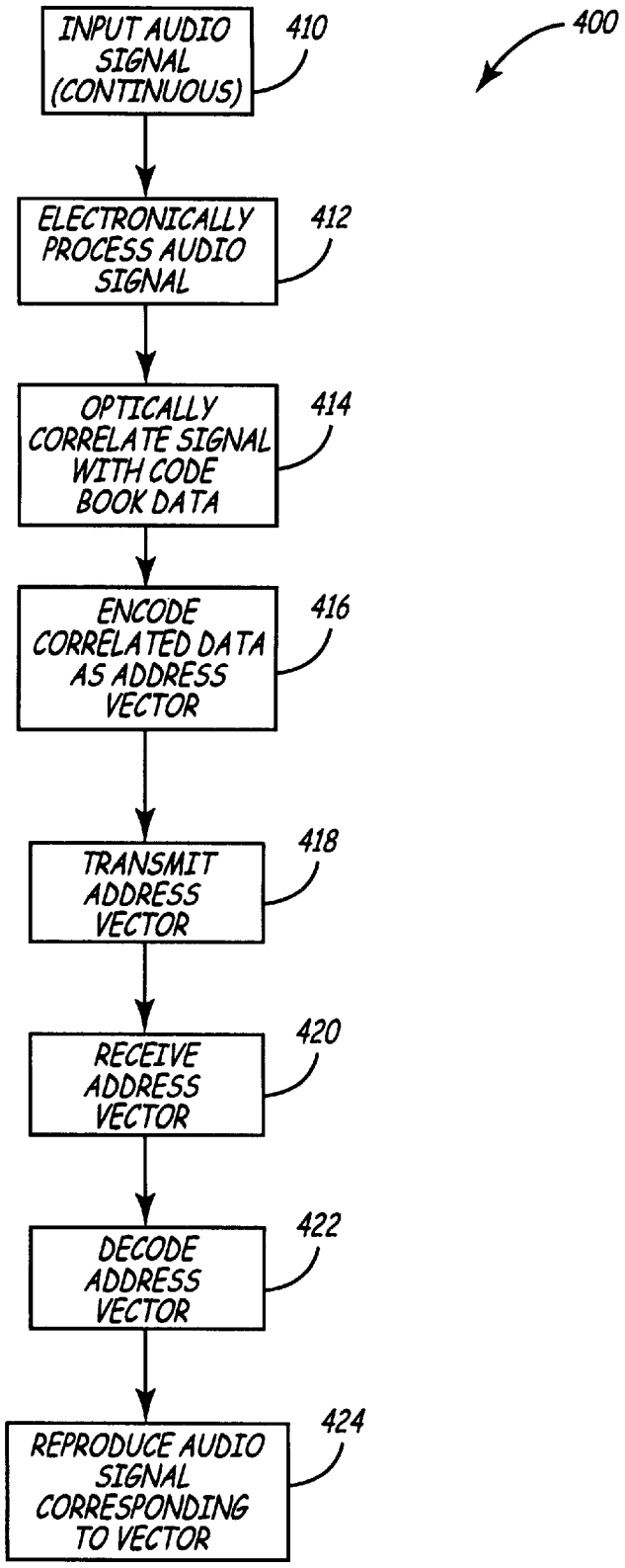
FIG. 4 is a flow diagram of a method for vector correlating a continuous speech signal using an optical processor in accordance with the present invention.

Referring now to FIG. 4, a flow diagram of a method for vector correlating a speech signal using an optical processor in accordance with the present invention will be discussed. Preferably, the method 400 is implemented in realtime with a continuous input audio signal. Method 400 is initiated at step 410 with the receiving of an audio input signal. The signal is electronically processed at step 412 (e.g., with digital processing system 114). The audio signal is then correlated (e.g., using optical processing system 116 as a correlator) with codebook data at step 414 to arrive at an address vector corresponding to the closest matched data in the codebook. The address vector encodes the location in the codebook of the codebook data matching the audio signal as an electrical signal that is transmitted at step 418 and received by an appropriate receiver at step 420. The address vector may be decoded at step 422 to determine the data stored in a codebook at the receiving end corresponding to the input audio signal. The audio signal then may be reproduced at the receiving end at step 424. Thus, a continuous audio signal may be correlated against an extremely large, massive amount of data (i.e. a very large codebook) in real-time to thereby produce a codebook vector capable of being transmitted over a lower bandwidth data channel. Since the audio signal is encoded as an address vector (e.g., a digital signal), the audio information is effectively equivalent to being compressed but without loss of fidelity or introduction of noise into the system.

In one embodiment of the present invention, audio processing system 100 may be implemented in an avionics environment to provide high fidelity voice communications between airplane pilots and traffic control operators. For example, transceiver 120 may be disposed in the cockpit of an airplane and transceiver 124 may be disposed in an air traffic control facility. Since the voice signals are encoded, preferably in real-time, as vectors (i.e. digital address signals), and since the codebooks may contain prerecorded voice or speech components, the decoded voice signals may be free of noise inherent in the transmission process. In an additional embodiment, audio processing system 100 may be utilized to perform language translation. For example, a voice signal in a first language (e.g., English) may be processed by digital processing system 114 and optical processing system 116, encoded into address vectors, for example by correlating the voice signal with an English language codebook, that are transmitted to digital processing system 126 and optical processing system 128 where the address vectors are then translated, preferably in real-time, into a second language (e.g., Spanish) using a Spanish language codebook. In an avionics environment, such language translation may be advantageously utilized for international flights where a pilot speaking one language is required to receive takeoff or landing instructions from an air traffic controller speaking in another language. Since the codebooks may contain prerecorded speech data, and since audio processing system 100 is utilized to perform language interpretation, preferably in real-time, language translation errors and misinterpretations between human operators may be reduced or effectively eliminated. Thus, in method 400, the step 422 of decoding the address vectors may include the step of translating the vector encoded from a first language into an audio signal in a second language wherein the second language audio signal is representative of the originally encoded audio signal.

It is believed that the vector correlator for speech vocoder using an optical processor of the present invention and many of its attendant advantages will be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof. It is the intention of the following claims to encompass and include such changes.

What is claimed is:

1. A system for processing and encoding audio information, comprising:

an audio transducer for receiving audio information and converting the audio information into a signal representative of the of the audio information;

a digital processing system for receiving the signal and for electronically processing the audio signal; and an optical processing system operatively coupled with said digital processing system for comparing the signal to a codebook of holographic image templates stored in the optical processing system to generate a codebook vector signal.

2. A system as claimed in claim 1, further comprising a transceiver, operatively coupled to the digital processing system, for receiving the codebook vector signal subsequent to processing by said processing system for transmitting the codebook vector signal over a low bandwidth transmission channel.

3. A system as claimed in claim 1, further comprising a data storage device, operatively coupled to said digital signal processing system, for storing the codebook vector signal subsequent to processing by said optical system.

4. A system as claimed in claim 1, said digital processing system comprising a semiconductor processor and a memory coupled to said semiconductor processor, said semiconductor processor for executing a program of instructions stored in said memory.

5. A system as claimed in claim 1, said optical processing system further comprising:

a spatial light modulator for encoding the signal into a spatially modulated light beam;

a lens system for presenting the light beam;

a photorefractive crystal for receiving the light beam from the lens system said photorefractive crystal refracting the light beam from the stored holographic image templates such that a refracted light beam is provided by said photorefractive crystal; and a detector for detecting the refracted light beam and providing the codebook vector signal.

6. A system as claimed in claim 1, said optical processing system being configured to perform a correlation algorithm on the signal and information holographically stored on said photorefractive crystal.

7. A system for processing and encoding audio information comprising:

means for receiving audio information and converting the audio information into a signal representative of the audio information;

means, operatively coupled to said audio information receiving means for electronically processing the audio signal; and means, operatively coupled with said electronic processing means, for performing an optical signal processing algorithm or function on the signal whereby the signal is holographically encoded into a codebook vector signal, the codebook vector signal being optimized for transmission over a lower bandwidth transmission channel.

8. A system as claimed in claim 7, further comprising means, operatively coupled to said electronic processing means, for receiving the codebook vector signal subsequent to processing by said optical signal processing means for transmitting the codebook vector signal over the lower bandwidth transmission channel.

9. A system as claimed in claim 7, further comprising means, operatively coupled to said electronic processing means for storing the codebook vector signal subsequent to processing by said optical processing means.

10. A system as claimed in claim 7, said electronic processing means comprising means for storing a program of instructions and means, coupled with said storing means, for executing the program of instructions stored in said storing means.

11. A system as claimed in claim 7, said optical processing means comprising:

means for encoding the signal onto a light beam;

means for directing the light beam;

means for holographically storing information said holographic storing means being actuated with a control light beam such that a refracted light beam is provided by said holographic information storing means; and means for detecting the refracted light beam and for providing an output in response thereto, the output of said detecting means being the code book vector signal representative of a signal processing routine performed on the signal by said optical processing means.

12. A system as claimed in claim 7, said optical processing means being configured to perform a correlation algorithm on the signal and information holographically stored on said holographic information storing means.

13. A method for processing and encoding audio information for transmission over a lower bandwidth channel, comprising:

receiving the audio information and transducing the audio information into a signal representative of the audio information;

electronically processing the signal;

optically processing the signal using a first optical processing system such that the signal is encoded by comparing the signal to a holographic image for optimal transmission over a lower bandwidth transmission channel;

transmitting from a transceiver the encoded signal over a lower bandwidth transmission channel to a remote transceiver;

receiving the encoded signal at the remote transceiver; and decoding the encoded signal by comparing the signal to a holographic image such that the audio information is obtained at a second optical processing system at the remote transceiver.

14. A method as claimed in claim 13, further comprising the step of storing the encoded signal in a data storage device subsequent to said optical processing step.

15. A method as claimed in claim 13, said optical processing step including the step of performing a correlation algorithm between the signal and codebook data holographically stored within a photorefractive crystal in the first optical processing system.

16. A method as claimed in claim 15, further comprising the step of arriving at an address vector in the first optical processing system, the address vector referencing a storage location within the photorefractive crystal containing codebook data corresponding to at least a portion of the audio information.

17. A method as claimed in claim 16, further comprising the step of decoding the address vector by determining the codebook data from the storage location within a photorefractive crystal in the second optical processing system referenced by the address vector.

18. A method as claimed in claim 13, said decoding step including the step of optically processing the encoded signal whereby the audio information is obtained at the second optical processing system.

19. A method as claimed in claim 13, the audio information being voice information in a first language, said decoding step including the step of translating the encoded signal into voice information in a second language, the second language voice information being representative of the first language voice information.

* * * * *